United States Patent [19]

Bohg et al.

[11] 4,388,861

[45] Jun. 21, 1983

[54] BANK FOR ACCOMMODATING SEVERAL PRINT HAMMER UNITS

[75] Inventors: Armin Bohg, Weil im Schönbuch; Kurt Hartmann, Calw-Heumaden, all of Fed. Rep. of Germany

[73] Assignee: International Business Machines Corporation, Armonk, N.Y.

[21] Appl. No.: 265,749

[22] Filed: May 21, 1981

[30] Foreign Application Priority Data

Sep. 19, 1980 [DE] Fed. Rep. of Germany ..... 80105617[U]

[51] Int. Cl.[3] ..... B41J 9/42

[52] U.S. Cl. ..... 101/93.02; 101/93.48; 101/93.34

[58] Field of Search ..... 101/93.02, 93.29–93.34, 101/93.48; 400/167

[56] References Cited

U.S. PATENT DOCUMENTS

| | | | |
|---|---|---|---|
| Re. 27,175 | 9/1971 | Arnold et al. | 101/93.33 |
| 3,349,696 | 10/1967 | Potter | 101/93.33 |
| 3,426,675 | 2/1969 | Dalton | 101/93.02 X |
| 3,468,246 | 9/1969 | Lee et al. | 101/93.34 |
| 3,556,002 | 1/1971 | Bragg | 101/93.48 |
| 3,593,657 | 7/1971 | Guzak | 101/93.33 |
| 3,636,865 | 1/1972 | Konkel et al. | 101/93.33 |
| 3,745,497 | 7/1973 | Cavella | 101/93.33 X |
| 3,811,377 | 5/1974 | Charlson et al. | 101/93.30 |

*Primary Examiner*—Edward M. Coven
*Assistant Examiner*—John A. Weresh
*Attorney, Agent, or Firm*—John S. Gasper

[57] ABSTRACT

Bank for accommodating adjacent ram units, each of which consists of a flat, narrow frame. An electromagnetic actuator for a ram, which is guided in two bores of the frame, is positioned in a recess of the latter. For accommodating and guiding the individual ram units the bank has a substantially U-shaped cross-section. At least on one of its two ends, the frame of each ram unit is provided with a flexible pin arranged between two frame sections. The frames are detachably mounted between the U-sections of the bank. Both U-sections have recesses for positively and/or non-positively accommodating the front or rear frame part and the pin, respectively.

6 Claims, 5 Drawing Figures

BANK FOR ACCOMMODATING SEVERAL PRINT HAMMER UNITS

TECHNICAL FIELD

This invention relates to print hammer devices and particularly to a support structure or bank for accommodating multiple print hammer units and particularly print ram units.

RELATED U.S. APPLICATION

Print ram units of the type particularly useful in practicing this invention are described in the co-pending U.S. application of A. Bohg and K. Hartmann, entitled "Electromagentically Operable Ram Actuator In Particular For Impact Printers", Serial No. 261,312, filed May 7, 1981, now U.S. Pat. No. 4,371,857.

BACKGROUND OF THE INVENTION

Line printers with a plurality of character positions utilize multiple print hammers assembled in so called print hammer banks. These print hammer banks serve to accommodate individual print hammer units each of which is associated with a particular print position. Print hammer banks have been provided for various print hammer actuators operating in accordance with different principles. These print hammer banks have interchangeability and interaction problems overcome by the present invention.

BACKGROUND ART

One type of print hammer is disclosed in U.S. Pat. No. 3,359,921, issued Dec. 26, 1967 to S. Arnold et al. which shows print hammers supported by leaf springs whose energy is stored in their deflected state to be used for print hammer actuation. The print hammer is electromagnetically fired by discontinuing the energization of an electromagnet retaining the print hammer. The preloaded hammers are held by an electromagnet common to all print hammers whose carrier shiftable and parallel and fixed to the leaf springs preforms a reciprocal movement perpendicular to the print line. This reciprocal movement serves to return the print hammers after firing. The individual print hammers are provided with flexibly mounted damping elements. These elements absorb the energy of the returning print hammers and latch the print hammers by means of resilient latches until the magnet yokes of the holding magnet have seized the print hammers in this very forward position. In addition, the damping elements are fixed to a pivotable support spanning various print positions and whose pivot point is staggered in a downward direction relative to the resilient latches by means of a cam type drive. The support can be pivoted for a short time to release the print hammers.

In a typical high speed impact printer such as the IBM printer Model 3203, each print hammer unit consists of a clapper magnet, a separate print hammer and a push rod for transferring kinetic energy from the clapper armature to the print hammer. By means of two set screws, each electromagnet is screwed to a base plate common to all print hammer units. Each time the flight time is adjusted, these screws (264 of them) have to be loosened and subsequently retightened. Each electromagnet transfers the recoil occurring during acceleration of the armature in full to the base plate. It is not possible to exchange individual print hammer units.

U.S. Pat. No. 3,593,657, issued July 20, 1971 to J. Guzak, Jr. describes a bank of print hammer modules supported by a bank frame structure. The frame structure uses a combination of vertical plates with horizontal bars or braces fixed to a horizontal base plate having grooves to align the individual hammer module frames. No means is provided to minimize recoil or magnetic interaction. Interchanging a hammer module requires disassembly of one of the horizontal bars as well as manipulation of module clamping devices.

SUMMARY OF THE INVENTION

It is the object of this invention to eliminate these disadvantages of prior art structures and to provide a bank for accommodating several print hammer units preferably print ram units of the type described in the related co-pending application and which meets the following requirements.

1. Each print ram unit should be individually exchangeable without disassembling the bank.
2. The full recoil of the print ram unit should not be transferred to the hammer bank.
3. Few fixing elements should be used to assemble the various ram units.

The above as well as other objects are accomplished in accordance with this invention by providing a bank for accommodating a plurality of adjacent ram units consisting of a flat, narrow frame having in a recess thereof, an electromagnetic actuator for the ram element which is guided in two bores of the frame. The bank further comprises a bank support having a substantially U-shaped cross-section. The frame of each ram unit is provided at least on one of its two ends with a flexure member such as a resilient pin arranged between two frame sections or extensions such that the frames are detachably mountable between upright support plates attached to a base of the bank support. The upright support plates of the bank support have recesses for positively engaging the front end of the ram unit frame and for non-positively accommodating the rear part of the unit frame and the flexible pin. In the preferred form, the recesses in the upright support plates of the bank support are vertical V-shaped grooves and the front end of the unit frame has a front edge which is wedge-shaped and the bank support is structured so that the adjacent ram actuators are staggered relative to each other to reduce interaction of the electromagnetic actuators. This arrangement allows individual insertion and removal, repair and replacement of hammer units without disassembling the bank support. Furthermore the individual ram units as structured so that a single tool may be used for unit removal.

Further advantages may be realized from the detailed description of the preferred embodiment as described in the following drawing in which.

DESCRIPTION OF THE PREFERRED EMBODIMENT

As seen in the related application, the actual electromagnetic actuator of the print ram unit is arranged in the recess of a flat, narrow frame and that the actual rod-shaped print ram is guided in two bores of this frame. It can also be seen that this ram at its end remote from printing interacts with a unilaterally fixed spring pin extending through an elongated hole of the ram. This spring pin serves to return the print ram after an operating stroke. Further details of the operation of the electromagnetic print ram actuator can be obtained be reference to the related co-pending application as these are not necessary for fully appreciating the bank structure described below for accommodating several print ram units.

Figure 1:
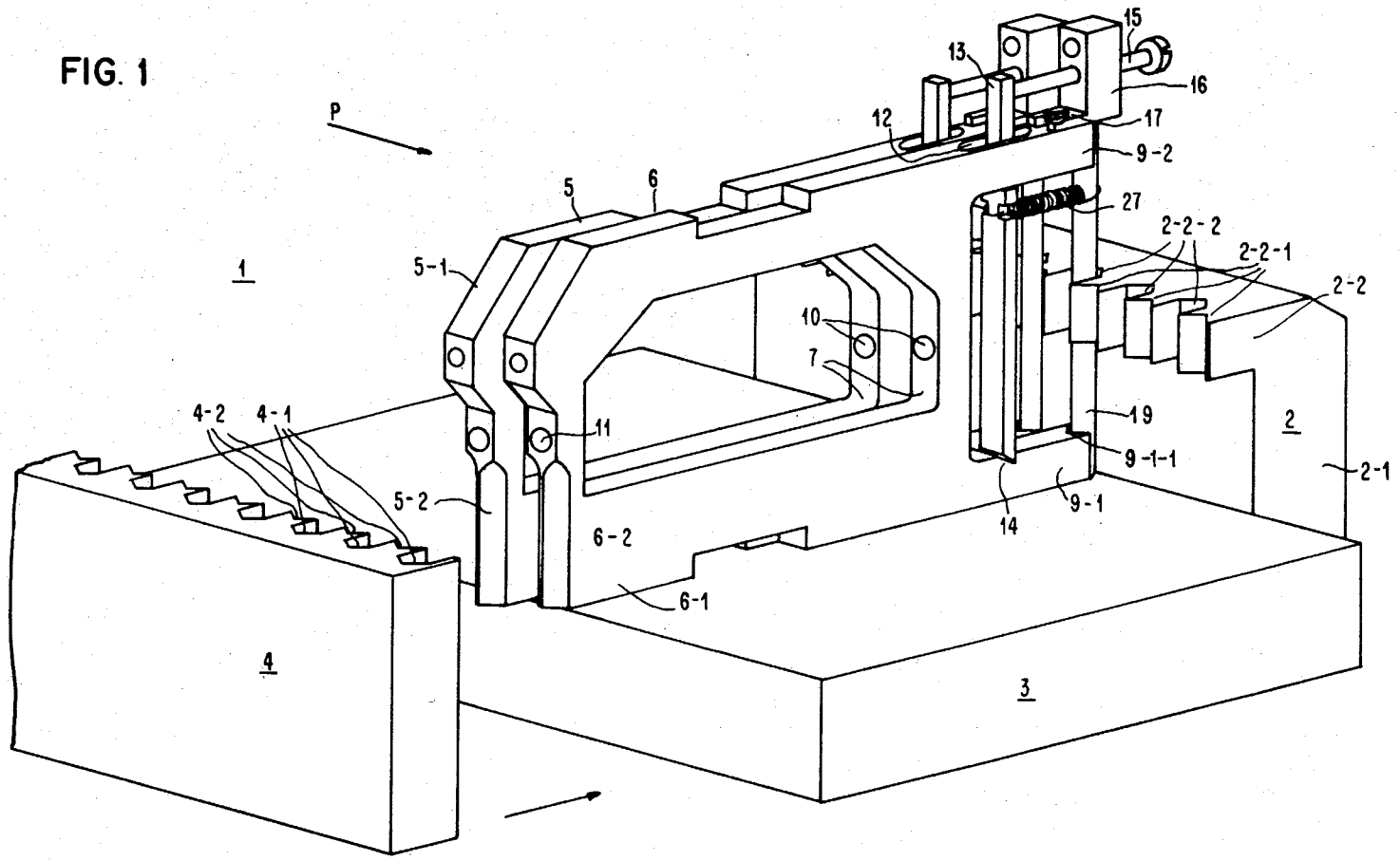
FIG. 1 is perspective view of a bank for accommodating several print ram units.

As shown in FIG. 1, the print ram units are designated as 5 and 6 and their unit frames are respectively designated as 5-1 and 6-1. To simplify the illustration, only two print ram units 5 and 6 are shown even though the bank 1 may accommodate a much greater number.

Figure 2:
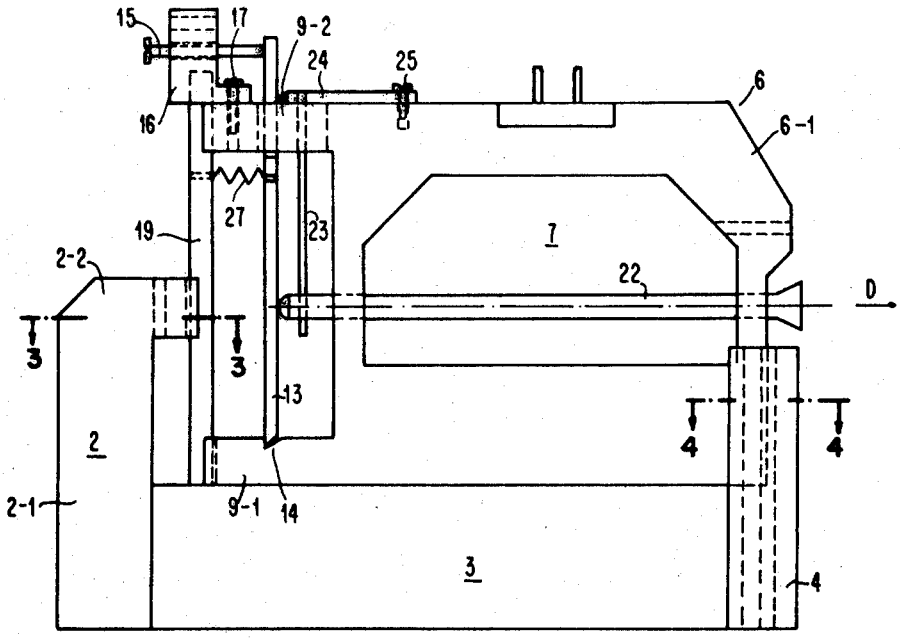
FIG. 2 is a simplified lateral view (looking in the direction of arrow P) of the bank in accordance with FIG. 1 with a print ram unit.

It may be seen that a print ram unit (see also FIG. 2) 6 consists of a flat, narrow rectangular frame 6-1. Print ram unit 5 has an identical frame 5-1. The frame of each print ram unit is provided with a recess 7 in which the actual electromagnetic actuator (not shown) for the print ram 22 is arranged. The print ram 22 (see FIG. 2) is guided in the bores 10 and 11 the front and rear sides of the frames 5-1 and 6-1. Each frame 5-1 and 6-1 has a keel-shaped or wedge-shaped edge 5-2 and 6-2 respectively at its front end and two i.e. upper and lower frame extensions 9-1 and 9-2 at the rear end. The frame extensions 9-1 and 9-2 have vertical V-shaped grooves 9-1-1 and 9-2-1 (see also FIG. 3) at their rear end. An angle piece 16 through which a set screw 15 extends is fixed to the upper frame extension 9-2 by means of the screw 17. This set screw 15 serves as a stop for a stopper bar 13 which has a knife edge support 14 in the lower extension 9-1 whence it extends upward through an elongated hole 12 in the upper frame extension 9-2. As shown in FIG. 2, the stopper bar 13 is held against the set screw 15 by means of a tension spring 27. FIG. 2 also shows how the spring pin 23 referred to above interacts with the actual print ram 22. This spring pin 23 is connected to a plate 24, which is connected to the upper frame extension 9-2 with the aid of screw 25. By energizing the electromagnetic actuator, not shown, the ram 22 is accelerated in operating direction D. Upon completion of printing, spring pin 23 returns ram 22 to its original position in which it is pressed against stopper bar 13 by the force of said spring pin 23.

It will be described below how the individual print ram units 5 and 6 are accommodated in the bank frame 1.

The bank support 1 is substantially U-shaped and comprises a base 3 with two vertical side supports or plates 4 and 2. The front plate 4 for accommodating the keel-shaped front edges 5-2 and 6-2 of the frames 5-1 and 6-1 has vertical sectional grooves 4-1 and 4-2 which are adapted to the keel shape. In the preferred form grooves 4-1 and 4-2 are V-shaped and edges 5-2 and 6-2 are wedge-shaped so as to form a positive and precise engagement of the parts. The rear support plate 2 of bank support 1 consists of two sections; a straight vertical wall 2-1 and an upper horizontal extension or bar 2-2 which extends inwardly. The latter extension or bar 2-2 is also provided with vertical sectional grooves 2-2-1 and 2-2-2 for accommodating the individual print ram units 5 and 6. The sectional grooves 2-2-1 and 2-2-2 serve to accommodate a flexure member such as a cylindrical resilient pin 19 extending between the V-shaped grooves 9-1-1 and 9-2-1 of the lower and upper unit frame extensions 9-1 and 9-2. The latter grooves are vertically aligned with each other. In the assembled state, the vertical supports 4 and 2 of bank support 1 are connected to base 3. This connection can be detachable using such means as screws or snap joints or the like. For adjacent unit frames, the sectional grooves in the vertical supports of bank support 1 have different depths so that only all even or odd unit frames are aligned with each other. This stagger alignment prevents adjacent print ram units from noticeably (for example, magnetically) interacting with each other during operation.

From FIG. 2, showing a simplified lateral view (looking in the direction of arrow P, FIG. 1) of the bank with the print ram unit 6, it may be seen in particular how the pin 19 arranged between the lower extension 9-1 and the upper extension 9-2 of frame 6-1 rests with its center part against the rear sectional groove 2-2-2 of the plate 2. This pin 19 must be resilient in the direction of print D, so that the recoil occurring during the firing of print ram 22 is transferred to the bank support 1 only in a damped form. It may also be seen from FIG. 2 that the pin 19 with its upper part is accommodated in a bore of the angle piece 16. Spring 27 also serves to retain pin 19 seated in grooves 9-2-1 and 9-1-1 of the upper and lower extensions 9-2 and 9-1.

Figure 3:
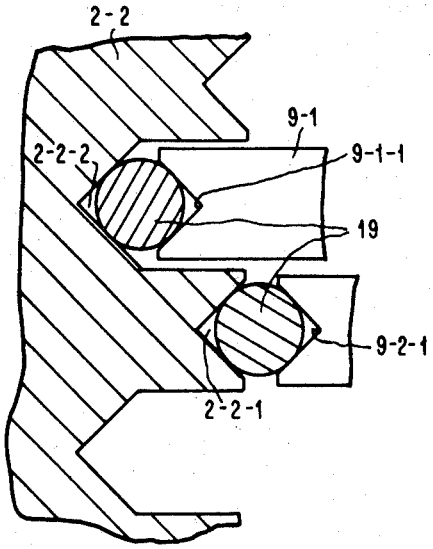
FIG. 3 is a partial sectional view of the bank with two print ram units taken along sectional line 3—3 of FIG. 2.
Figure 4:
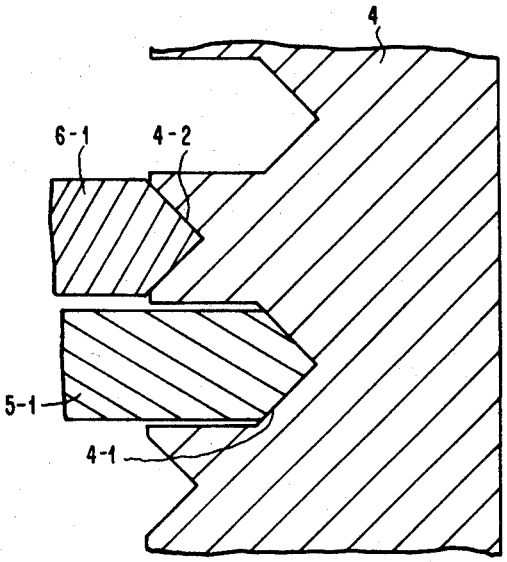
FIG. 4 is a partial sectional view of the bank with two print ram units along sectional line 4—4 in FIG. 4.

The mutual stagger of the individual print ram units may be seen in particular from FIGS. 1, 3 and 4.

FIG. 3 is a partial sectional view of the bank (with two print ram units) along sectional line 3—3 in FIG. 2, whereas FIG. 4 is a partial sectional view of the bank (with two print ram units) along sectional line 4—4 in FIG. 2. FIG. 3 thus refers to the mounting and guidance of the rear parts of the print ram units, whereas FIG. 4 refers to the mounting and guidance of the front parts of the print ram units.

The V-shaped sectional grooves in bar 2-2 of support plate 2 of the bank support 1 are designated as 2-2-1 and 2-2-2. It may be seen that the sectional grooves have different depths and that the pins 19 of the frame extend to the bottom of these sectional grooves.

For guiding the front frame parts, attention is drawn to FIG. 4. The V-shaped sectional grooves 4-1, 4-2 for adjacent frames 5-1 and 6-1 again have different depths. The sectional groove for the frame 6-1 is designated as 4-2 and that for the frame 5-1 as 4-1. These V-shaped grooves have different depths, taking into account the frame stagger. They are adapted to the keel-shaped front part 6-2, 5-2 of the frames 6-1 and 5-1, the width of the grooves arranged more deeply slightly exceeding the actual frame width.

Figure 5:
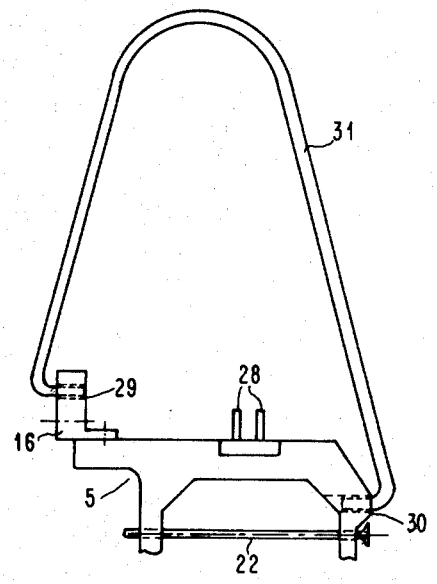
FIG. 5 is a simplified representation of an extractor tool for removing a print ram unit from the bank.

FIG. 5 is a simplified representation of an extractor tool for removing a print ram unit from the bank. This tool is a suitably handle-shaped wire 31 with bent ends which can be inserted into the horizontal bores of the angle piece 29 and (30), respectively, in the front frame part. In this manner, the individual frame units can be removed from the bank 1, if required, (by loosening the front and the rear frame element 2 and 4, respectively) or be inserted into it. Such loosening may be effected, for example, by partly loosening a screw connection serving to link the support plates 4 and 2 of the bank with the base 3.

We claim:

1. A print hammer bank assembly comprising a plurality of individual print actuator units and a bank support for maintaining said plurality of actuator units removably stacked in a side by side relationship;

said actuator units each including a thin, flat, rectangular frame member having front and rear sides defining front and rear vertical mounting edges, said frame member having a central recess for carrying an electromagnetic operating means between said front and rear sides, said front and rear sides of said frame member having guide holes therein, a cylindrical impactor element slidable within said guide holes, said inpactor element being movable by said operating means in a horizontal direction perpendicular with said front and rear mounting edges, recoil damping means carried by said frame member along said rear vertical mounting edge, said recoil damping means being resilient in the direction perpendicular with said front and rear vertical mounting edges of said frame member; and said bank support having a substantially U-shaped cross-section comprising a horizontal base connected between a front and a rear upright support plate, said front upright support plate having fixed locating means for removably receiving and retaining said front vertical mounting edge of said frame member at an impact operating position, said rear upright support plate having fixed locating means engaging said recoil damping means along said rear vertical mounting edge of said frame member for damping recoil transfer to said bank support.

2. A print hammer bank assembly in accordance with claim 1 in which said locating means of said front and rear upright support plates comprises vertical groove means in the interior surfaces thereof, said front vertical mounting edge of said frame member comprises a surface shaped for slidably engaging said vertical groove means of said front upright support plate, and said recoil damping means is carried along said rear vertical mounting edge of said frame member for engaging said vertical groove means in said rear upright plate.

3. A print hammer bank assembly in accordance with claim 2 in which said frame member further has parallel extensions extending from said rear side of said frame member toward said rear upright support plate, said recoil damping means comprises a flexure member supported at opposite ends by said parallel extensions in position along said rear vertical mounting edge of said frame member, and said locating means on said rear upright support plate of said bank support comprises vertical groove means for positively engaging said flexure member at a position between said parallel extensions of said frame member.

4. A print hammer bank assembly in accordance with claim 3 in which said flexure member is a resilient pin supported by said parallel extensions of said frame member, said parallel extensions being coplanar with said rear vertical mounting edge, said parallel extensions having vertical groove means for positively engaging the surface of said resilient pin at said opposite ends thereof.

5. A print hammer bank assembly in accordance with claim 4 in which said vertical groove means of said parallel extensions are V-shaped grooves, and said resilient pin is cylindrical.

6. A print hammer bank assembly in accordance with claim 4 in which said rear support plate of said bank support comprises an upright portion connected to a horizontal bar extending inwardly toward said front upright support plate, and said locating means for engaging said resilient pin on the rear vertical mounting edge of said frame member comprises vertical groove means formed in the end surface of said horizontal bar for engaging said resilient pin intermediate said parallel extensions of said frame member.

* * * * *